US011014128B2

(12) United States Patent
Ransom

(10) Patent No.: US 11,014,128 B2
(45) Date of Patent: May 25, 2021

(54) CLEANING SYSTEM AND METHODS

(71) Applicant: Cody Collins Ransom, Layton, UT (US)

(72) Inventor: Cody Collins Ransom, Layton, UT (US)

( * ) Notice: Subject to any disclaimer, the term of this patent is extended or adjusted under 35 U.S.C. 154(b) by 24 days.

(21) Appl. No.: 15/339,934

(22) Filed: Nov. 1, 2016

(65) Prior Publication Data

US 2018/0116477 A1 May 3, 2018

(51) Int. Cl.

| | |
|---|---|
| ***B08B 3/10*** | (2006.01) |
| ***C11D 7/04*** | (2006.01) |
| ***C11D 11/00*** | (2006.01) |
| ***A47L 11/40*** | (2006.01) |
| ***C11D 17/04*** | (2006.01) |

(52) U.S. Cl.

CPC ..... *B08B 3/10* (2013.01); *A47L 11/4083* (2013.01); *C11D 7/04* (2013.01); *C11D 11/0017* (2013.01); *C11D 11/0023* (2013.01); *C11D 17/04* (2013.01)

(58) Field of Classification Search

CPC ..... B08B 3/10; C11D 7/04; C11D 11/0017; C11D 11/0023; C11D 17/04; A47L 11/4083

See application file for complete search history.

(56) References Cited

U.S. PATENT DOCUMENTS

| | | | | |
|---|---|---|---|---|
| 3,352,642 | A * | 11/1967 | Heidt | C01B 13/10 423/265 |
| 5,493,754 | A * | 2/1996 | Gurstein | A47L 11/34 15/246.3 |
| 2004/0045886 | A1* | 3/2004 | Abe | C02F 1/325 210/198.1 |
| 2006/0272120 | A1* | 12/2006 | Barrick | G01F 23/58 15/321 |
| 2017/0321365 | A1* | 11/2017 | Rupnow | D06F 39/022 |
| 2020/0325348 | A1* | 10/2020 | Schmidt | G02B 5/0825 |

FOREIGN PATENT DOCUMENTS

| | | | | |
|---|---|---|---|---|
| JP | 10295784 | * | 11/1998 | A61L 2/10 |

OTHER PUBLICATIONS www.dictionary.com/browse/room-temperature, Dec. 18, 2018.*

* cited by examiner

*Primary Examiner* — Amina S Khan

(74) *Attorney, Agent, or Firm* — Robert L. Lundstrom

(57) ABSTRACT

A cleaning system for cleaning textiles and floor, wall and counter coverings includes a container having an inlet and an outlet and containing a predetermined volume of cleaning solution having at least one hydroxyl radical. A cleaning instrument is operably fluidly coupled the container, operable to disperse the cleaning solution to a surface to be cleaned. A vacuum is associated with the cleaning instrument for collecting dispersed cleaning solution. The cleaning solution can be applied at a relatively low temperature.

7 Claims, 3 Drawing Sheets

CLEANING SYSTEM AND METHODS

PRIORITY CLAIM

This patent application claims benefit of U.S. Provisional Patent Application No. 62/249,256, filed on Oct. 31, 2015, which is incorporated by reference in its entirety for all purposes.

BACKGROUND OF THE INVENTION

Field of the Invention

The present invention relates generally to methods, apparatuses, systems, and structures for cleaning textile surfaces such as carpets or upholstery, and hard surfaces such as hard wood floors or ceramic floor tiles.

Related Art

The floors of many homes are covered with carpets and/or rugs, or other flooring options such as hardwood floors, engineered hardwood floors, linoleum, tile, vinyl, laminate, and the like. These floorings are comfortable and useful, however, they constantly become soiled and laden with dirt, stains, and bacteria of various kinds, and therefore require cleaning and disinfecting.

Current conventional carpet and upholstery cleaning systems typically include equipment to heat water and cleaning solutions, disperse the water-solution to the carpet or upholstery, and vacuum the water-solution back out of the carpet. Aside from the agitation of the carpet by the process of dispersing or applying the water-solution to the carpet, the cleaning mechanism for such systems relies primarily on the heat and chemistry of the water-solution to attack and break down dirt molecules in order to separate them from fibers so that they can be removed from the carpet or upholstery by the vacuum.

Unfortunately, heat and chemicals are problematic to the cleaning system and process. For example, heating the cleaning solution, whether water alone or water plus chemical solution, adds costs of heating equipment and energy to the cleaning system and process. Moreover, hot water and steam can cause injury to a user. Additionally, adding chemicals to the water not only adds the costs and toxicity hazards of the chemicals, but can also leave unwanted chemical residues on the carpets, textiles and surfaces being cleaned.

SUMMARY OF THE INVENTION

The inventor of the present invention has recognized that it would be advantageous to develop a cleaning and disinfecting system and method for carpet, upholstery, textiles, ceramic and hardwood flooring, and the like, that uses an Advanced Oxidation Process (AOP) to create hydroxyl radicals in water used as a cleaning solution that remove unwanted material such as organic and inorganic contaminants from the surface to be cleaned. Furthermore, the inventor has recognized that it would be advantageous to develop a cleaning system and method that can clean carpet, upholstery, textiles, ceramic and hardwood flooring, and the like, with cleaning solutions such as water at relatively low ambient or room-like temperatures.

The invention provides for a cleaning system for cleaning textiles and floor, wall and counter coverings including a container having an inlet and an outlet and containing a predetermined volume of cleaning solution having at least one hydroxyl radical. A cleaning instrument can be operably fluidly coupled the container, operable to disperse the cleaning solution to a surface to be cleaned. A vacuum can be associated with the cleaning instrument for collecting dispersed cleaning solution.

In another aspect, the present invention provides for a cleaning system for cleaning textiles and floor, wall and counter coverings including a container having an inlet and an outlet and containing a predetermined volume of cleaning solution having a relatively low operating temperature. A cleaning instrument can be operably fluidly coupled the container, operable to disperse the cleaning solution to a surface to be cleaned. A vacuum can be associated with the cleaning instrument for collecting dispersed cleaning solution.

The present invention also provides for a method for cleaning surfaces including processing a cleaning solution to add ozone to the cleaning solution. The cleaning solution can be exposed to ultra-violet light in order to create the presence of at least one hydroxyl radical within the cleaning solution. The cleaning solution can be distributed over at least a portion of a surface to be cleaned such as a carpet, fabric, textile, floor covering, ceramic tile, hardwood, linoleum, laminate flooring, and the like.

Additional features and advantages of the invention will be apparent from the detailed description which follows, taken in conjunction with the accompanying drawings, which together illustrate, by way of example, features of the invention.

DETAILED DESCRIPTION

Figure 1:
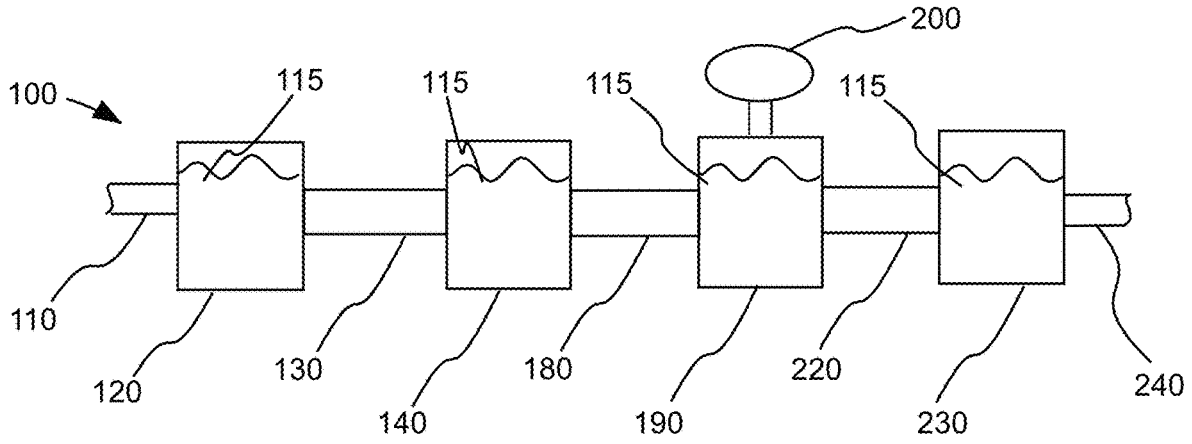
FIG. 1 shows a schematic of a cleaning system used for producing the processed cleaning solution according to an embodiment of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The embodiments of the present invention described herein provide generally for a cleaning system for textile and hard surfaces such as carpet, upholstery, textiles, fabric, ceramic and hardwood flooring, and the like. The cleaning system can create and use hydroxyl radicals (—OH) for breaking down and removing contaminants such as unwanted dirt, grime, soils, bacteria, germs, and the like. Additionally, the cleaning system can operate at ambient or room-like temperatures and requires no additional heating of water or cleaning solution.

The cleaning system can include a cleaning solution container fluidly coupled to an ozone processing container that can introduce ozone ($O_3$) into a cleaning solution such as water. The system can also include a hydroxyl radical processing unit fluidly coupled to the ozone processing container that can expose and irradiate the ozone rich cleaning solution with ultra-violet (UV) light. Once exposed to the ultra-violet light, the ozone in the ozone rich water can cause the release of neutral OH molecules, or hydroxyl radicals, into the water. Together the $O_3$ and UV processes act as an Advanced Oxidation Process (AOP) that creates hydroxyl radicals in the water. Other AOP processes, as known in the art, may also be used to introduce or create the hydroxyl radicals in the cleaning solution.

The hydroxyl radical processing container in the cleaning system can be fluidly coupled to a cleaning instrument, such as a wand, that disperses and applies the cleaning solution to the subject material of the cleaning process. Once in contact with the surface material to be cleaned, the hydroxyl radicals of the cleaning solution break down and separate unwanted contaminants from the surface material. A vacuum can then be used to vacuum up the cleaning solution and contaminants leaving the newly cleaned surface disinfected and relatively odorless.

The embodiments of the present invention provide several advantages over currently existing carpet, upholstery, and floor covering cleaning systems which will be described throughout this specification. Additionally, an advantage of the present invention is that the cleaning solutions or compositions described herein are applicable to all carpet types, and are also safe to all carpet dye types, particularly sensitive natural dyes used therein. The compositions of the present invention are also suitable to be used to clean upholstery and car seats covering. Furthermore, the compositions herein may also be used in laundry applications as a laundry detergent or additive or even in a laundry pretreatment application as well as in hard surfaces applications to clean for example tiles, floors, grouting, sinks, fiberglass, plastics and the like.

Another advantage of the compositions of the present invention is that the cleaning solutions may be applied directly on the carpet without causing damage to the carpet. In addition, the cleaning action of the invention commences as soon as the carpet cleaning composition has been applied to the surface. Indeed, the use of a carpet cleaning composition of the present invention does not necessarily require rubbing, scrubbing, agitation, and/or brushing of the carpet.

In order that the present invention may be more fully understood, exemplary embodiments will now be described with reference to the accompanying drawings.

Figure 2:
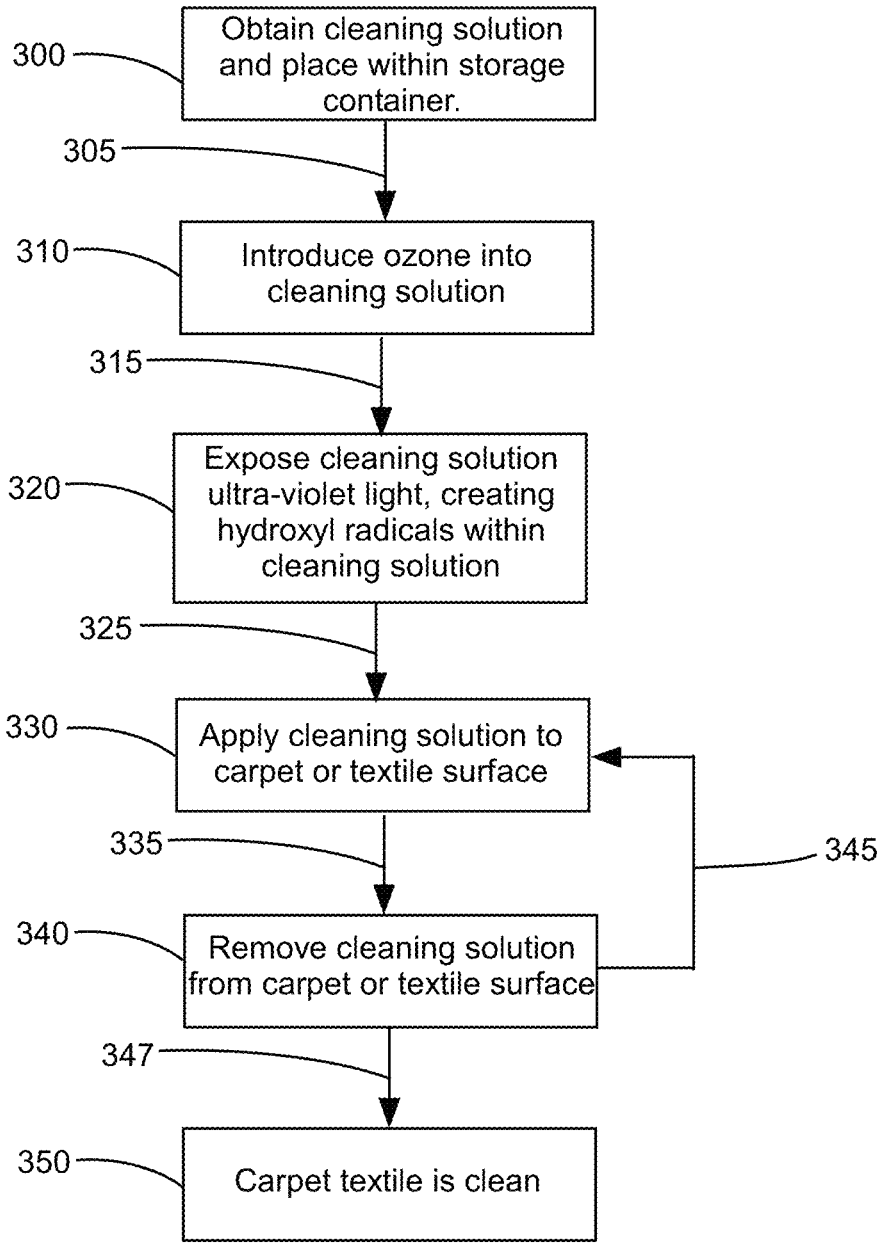
FIG. 2 illustrates carpet cleaning equipment utilizing the processed cleaning solution in accordance with another embodiment of the present invention.
Figure 3:
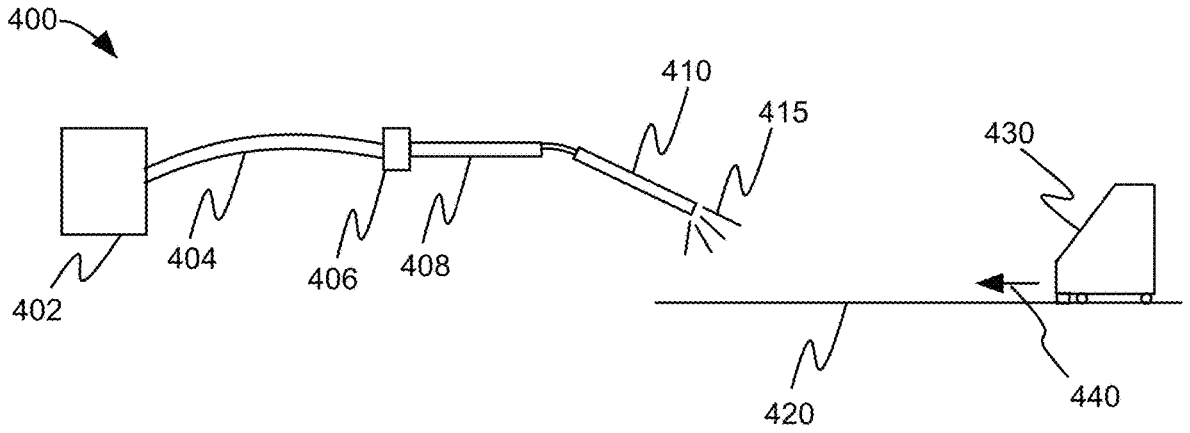
FIG. 3 illustrates a flow chart outlining the steps of the cleaning solution processing in accordance with an embodiment of the present invention.

As illustrated in FIGS. 1-3, a cleaning system, indicated generally at 100, is shown in schematic form, in accordance with an embodiment of the present invention, for use in cleaning textile covered surfaces, such as carpet, and hard floor, wall and countertop surfaces, such as ceramic tile. The cleaning system 100 may, in some exemplary embodiments, comprise a cleaning solution container 120, containing a volume of cleaning solution 115, such as water. The cleaning solution 115 may be transferred to the cleaning solution container 120 via inlet tube 110. The cleaning solution container 120 may be formed from standard materials, such as, for example, hard plastics, metals, fiberglass, and the like, as known in the art.

As noted, in some exemplary embodiments, the cleaning solution 115 may comprise water. In other exemplary embodiments, the cleaning solution 115 may comprise water-based solutions containing additional additives, such as cleaning agents, surfactants, or added deodorizers and scented materials.

The cleaning solution 115 may be transferred from the cleaning solution container 120 to an ozone processing container 140. The ozone processing container 140 may be operable to introduce at least one molecule of ozone into the cleaning solution 115. In some exemplary embodiments of the present invention, millions of molecules of ozone may be introduced into the cleaning solution 115. Introducing ozone to the cleaning solution 115 can make the solution ozone rich. In the case where the cleaning solution is water, the water can become ozone rich water after being infused with ozone via the ozone processing container 140.

Ozone is a reactive molecule having the chemical composition $O_3$. Ozone rich or Ozone-infused water reacts with microbial contamination present on textiles such as carpet and removes the microbial contamination from textiles and carpets, and therefore acts as a cleansing agent when in solution. Ozone may be introduced into the cleaning solution 115 by methods well-known in the art. There are several commercially available options and systems to introduce ozone and convert water to ozone water. The presence of ozone within water provides for a safe way to remove food residue, germs, mold and mildew, and to remove odors without the use of harsh chemical odors and other residue left behind.

In some exemplary embodiments, after processing the cleaning solution 115 for the addition of ozone to the cleaning solution 115, the cleaning solution 115 can be further processed. Subsequent to the addition of ozone to the cleaning solution 115, the cleaning solution 115 can be passed through flow tube 180 into the hydroxyl radical processing container 190.

The hydroxyl radical processing container 190 can further process the textile cleaning solution 115. The hydroxyl radical processing container 190 can include a hydroxyl radical processing unit such as an ultra-violet (UV) light 200. The hydroxyl radical processing container 190 can be made from common materials, such as polyurethane or other plastics, as known in the art.

The UV light 190 can be shaped, sized and positioned in close proximity to the hydroxyl radical processing container 190. The hydroxyl radical processing container 190 can include an outer material that is transparent, such that the radiation emanating from an ultra-violet light 200 can pass through the transparent material and can irradiate and affect the textile cleaning solution 115.

In the embodiment shown in FIG. 1, the ultra-violet light 200 can be contained within the hydroxyl radical processing container 190. The ultra-violet light 200 can be contained within a fluid-tight case, enabling the ultra-violet light 200 to operate within the hydroxyl radical processing container 190 along with the cleaning solution 115.

The ultra-violet light 200 can also be configured to be activated. Upon activating the ultra-violet light 200, a chemical reaction will occur within the ozone rich cleaning solution 115, causing the release of an OH (neutral) molecule into the water. In some exemplary embodiments of the present invention, millions of molecules of OH may be introduced into the cleaning solution 115.

In some exemplary embodiments, subsequent to processing the cleaning solution 115, the cleaning solution 115 can be transferred from the hydroxyl radical processing container 190 to the flow tube 210 and into the storage container 220. The storage container 220 can store the cleaning solution 115 until the cleaning solution 115 is applied to at least a portion of a surface to be cleaned.

As hydroxyl radicals can have a substantially short half-life (on the order of approximately two seconds or less), the cleaning solution 115 may be pumped from container 190 to application onto the subject textile within the hydroxyl radical's half-life. In some embodiments (not shown), an ultraviolet light may be applied to the textile cleaning solution 115 immediately prior to the point of application to the textile or carpet, ensuring delivery to the textile or carpet within the hydroxyl radical's half-life.

It will be appreciated that temperature can greatly affect the half-life of the hydroxyl radicals. For this reason, the ozone rich and subsequent hydroxyl radical rich cleaning solution 115 can be maintained at relatively low temperatures. For example, the cleaning solution 115 can have a temperature between approximately 40 and 90 degrees Fahrenheit. Advantageously, the ideal temperature range of the cleaning solution usually corresponds to the ambient temperature of the surrounding environment such that additional heating equipment and associated costs of providing energy to heating equipment is not needed for the present invention. Additionally, use of relatively lower temperature solutions provides the advantage of minimizing wear and tear on carpet, upholstery and other textile materials which can experience color, adhesive and other material failures when subjected to hot water used during cleaning processes. It should be noted that using relatively lower temperatures for cleaning purposes is contrary to the teachings of other carpet cleaning processes and carpet manufacturer recommendations, but is helpful in the present invention in retaining the presence of the hydroxyl radicals in the cleaning solution 115.

In further exemplary embodiments, hydroxyl radicals may be processed such that the half life may last for much longer, in some cases up to 18 minutes. In such cases the cleaning solution 115 can be transferred to container 230 via fluid tube 220 and can remain there until ready for dispersal over a textile surface, such as, for example, carpet. In further embodiments, the textile cleaning solution 115 can be moved from container 230 via fluid tube 240 and can subsequently be dispersed onto a surface to be cleaned such as a textile carpet or ceramic tile.

In further exemplary embodiments of the invention, an ultra-violet light 200, such as a blue ultra-violet light can be utilized to generate sufficient current to break up oxygen molecules into oxygen atoms. These free oxygen molecules may be pumped into a textile cleaning solution, such as water. The textile cleaning solution may comprise water or a water-based solution. Upon entering the water, the free oxygen atoms may bond with other oxygens, forming $O_3$, or ozone. This may then be exposed again to a blue ultra-violet light, forming OH molecules, or hydroxyl radicals. This may be done in separate containers, or in some exemplary embodiments, these processes may be performed within the same container.

Upon the exposure of ultra-violet light to a cleaning solution 115 having ozone present therein, the ultra-violet light may convert the ozone to a different substance such that when the textile cleaning solution is applied to a textile, ozone is no longer present in the solution, and it is not applied to the textile or carpet.

FIG. 2 illustrates a flow chart outlining a method or process according to an embodiment of the present invention. As described in block 300, first a cleaning solution must be obtained and positioned within a container. Typically, this container would be capable of, or equipped with the necessary tools to, inject and infuse ozone into the cleaning solution. As discussed herein, the cleaning solution may comprise water, a water-solution, such as water mixed with scented substances or otherwise.

As shown in block 310, after obtaining the cleaning solution, ozone is introduced into the cleaning solution. This may be accomplished by the means discussed herein and shown in FIGS. 1 and 3.

Subsequent to step 310, as shown in block 320, the cleaning solution can be treated with ultra-violet light, creating hydroxyl radicals within the cleaning solution. This may be accomplished in the same container where ozone was introduced to the cleaning solution, or it may be performed in a different container.

The process or method may further include applying the processed and treated cleaning solution to a surface comprising a textile, as shown in block 330. The cleaning solution may further be applied to other surfaces, such as, for example, may comprise surfaces comprising carpet, hardwood floors, engineered hardwood floors, laminate floors, vinyl floors, linoleum floors, tile floors, rugs, and so on. It is contemplated as well by the present application that the process may be applicable also on upholstered items, such as leather, vinyl, cloth, and microfiber couches and chairs. The process may also be applicable to finished and unfinished surfaces.

Block 340 describes wherein the cleaning solution is subsequently removed from the textile. The cleaning solution may be removed from the textile by conventional means.

As illustrated by arrow 345 and block 330, after removing the cleaning solution from the textile, the cleaning solution may be reapplied to the textile if necessary. Subsequent to removing the cleaning solution from the textile, there remains a clean, disinfected textile, as shown in block 350.

As illustrated in FIG. 3, another cleaning system, indicated generally at 400, is shown in accordance with another embodiment present invention for cleaning textiles, such as textile 420, illustrated in FIG. 3. Cleaning system 400 may comprise a container 402. In some embodiments the container 402 may be operable to introduce ozone to a volume of textile cleaning solution. In further embodiments, the container 402 may be operable to have an ultra-violet light coupled to the container 402. The ultra-violet light may be operable to create hydroxyl radicals within the textile cleaning solution.

The system 400 can further comprise a flow tube 404 operable to conduct the treated textile cleaning solution from the container 402 to hydroxyl radical processing unit 406. In some embodiments, hydroxyl radical processing unit 406 may expose the textile cleaning solution to ultra-violet light, creating hydroxyl radicals within the textile cleaning solution. The textile cleaning solution may then be transferred through flow 408 into a cleaning instrument 410. The cleaning instrument 410 may be operable to disperse the textile cleaning fluid across the textile 420 but creating a spray 415. The cleaning instrument 410 may, in some embodiments, comprise a wand. In other embodiments, the cleaning instrument 410 may comprise other director applicators such as carpet cleaning machines, advanced vacuum cleaners with liquid application capability. The use of other tools and carpet or textile cleaning products, as known in the art, is contemplated herein, by the application of hydroxyl radical infused ozone-textile cleaning solution to carpet and/or textiles.

These tools and methods described herein may be operable to operate adjacent to each other and to be substantially mobile, such that the processes and methods described herein may be performed at various and multiple workstations at different locations. The treatment of any textile cleaning solution may be performed in a vehicle or in a building using remote equipment.

Furthermore, as shown in FIG. 3, a vacuum 430 may be utilized to suck up and remove the used textile cleaning solution containing bacteria and other pollutants from the textile 420 in the direction of arrow 440.

In certain further exemplary embodiments of the invention, a textile cleaning solution may be treated with and infused with a certain percentage by volume of colloidal silver particles for further cleansing abilities. The colloidal silver may be applied to a textile cleaning solution that has been treated to introduce ozone and/or hydroxyl radicals, or may be applied to a textile cleaning solution, such as water, that has not been so treated.

The present invention also provides for a method for cleaning surfaces including processing a cleaning solution to add ozone to the cleaning solution. The cleaning solution can be exposed to ultra-violet light in order to create the presence of at least one hydroxyl radical within the cleaning solution. The cleaning solution can be distributed over at least a portion of a surface to be cleaned such as a carpet, fabric, textile, floor covering, ceramic tile, hardwood, linoleum, laminate flooring, and the like.

The method of can include providing the cleaning solution to a cleaning apparatus such that the cleaning solution may be distributed over at least a portion of the surface to be cleaned. The cleaning solution can be provided a cleaning instrument such as a wand, a mobile station, and the like.

The method can also include removing the textile cleaning solution from the textile.

The method can also include processing the cleaning solution in a mobile work station such as an automotive vehicle or a trailer.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A cleaning system for cleaning textiles and floor, wall and counter coverings, comprising:

a) a cleaning solution container having an inlet and an outlet and containing a predetermined volume of water-based cleaning solution having a relatively low operating temperature;

b) a first blue ultra-violet (UV) light operably associated with the cleaning solution container and operable to break up oxygen molecules in the cleaning solution container to form ozone within the water-based cleaning solution;

c) a second blue ultra-violet light operably associated with the cleaning solution container and operable to change ozone in water-based cleaning solution into hydroxyl radicals such that only hydroxyl radicals remain within the water-based cleaning solution;

d) a pump operably associated with the cleaning solution container and operable to move fluid out of the cleaning solution container within a half-life of hydroxyl radicals in the water-based cleaning solution; and e) a cleaning instrument operably coupled to the pump, and operable to disperse the water-based cleaning solution to a surface to be cleaned within the predetermined half-life of the hydroxyl radicals in the water-based cleaning solution.

2. The system of claim 1, wherein the relatively low operating temperature of the cleaning solution is a between approximately 40 and 90 degrees Fahrenheit.

3. The system of claim 1, wherein the cleaning solution is water that has been infused with free oxygen to form ozone and exposed to the blue UV light to create at least one hydroxyl radical in the cleaning solution.

4. The system of claim 1, further comprising:

a) an ozone processing container associated with the initial blue UV light wherein:

i) the initial blue UV light is operable to form at least one molecule of free oxygen in the ozone processing container; and ii) the ozone processing container is operable to introduce the free oxygen into the cleaning solution to create an ozone rich cleaning solution; and b) a hydroxyl radical processing unit operably associated with the subsequent blue UV light and operable to induce a chemical reaction within the ozone rich cleaning solution causing the release of at least one OH (neutral) molecule into the water-based cleaning solution to create at least one hydroxyl radical in the water-based cleaning solution.

5. The system of claim 4, wherein the hydroxyl radical processing unit includes a blue ultraviolet (UV) light sized, shaped, and positioned to expose the ozone rich cleaning solution from the ozone processing container to blue UV light to induce the chemical reaction in the cleaning solution causing the formation of the at least one OH molecule in the water-based cleaning solution immediately prior to application to a surface being cleaned.

6. The system of claim 5, wherein the cleaning solution is water such that the ozone processing container introduces ozone into the water to create ozone rich water; and wherein the hydroxyl radical processing unit exposes the ozone rich water to blue UV light to cause a chemical reaction with the ozone rich water that creates hydroxyl radicals in the water.

7. The system of claim 6, wherein the ozone processing container and the hydroxyl radical processing unit together form an Advanced Oxidation Process (AOP) for forming hydroxyl radicals in the cleaning solution.

* * * * *